US009949588B1

(12) United States Patent
Stine

(10) Patent No.: US 9,949,588 B1
(45) Date of Patent: Apr. 24, 2018

(54) SHOWER ROD HOLDER

(71) Applicant: MRS SOLUTIONS, LLC, Merritt Island, FL (US)

(72) Inventor: John Stine, Merritt Island, FL (US)

(73) Assignee: MRS Solutions, LLC, Merritt Island, FL (US)

( * ) Notice: Subject to any disclaimer, the term of this patent is extended or adjusted under 35 U.S.C. 154(b) by 0 days.

(21) Appl. No.: 15/486,087

(22) Filed: Apr. 12, 2017

Related U.S. Application Data

(60) Provisional application No. 62/321,817, filed on Apr. 13, 2016.

(51) Int. Cl.

| | |
|---|---|
| ***A47H 1/08*** | (2006.01) |
| ***A47H 1/142*** | (2006.01) |
| ***A47H 1/022*** | (2006.01) |
| ***A47K 3/38*** | (2006.01) |

(52) U.S. Cl.
CPC ..... *A47H 1/142* (2013.01); *A47H 1/022* (2013.01); *A47K 3/38* (2013.01)

(58) Field of Classification Search
CPC ..... A47H 1/14; A47H 1/142; A47H 1/144; A47H 1/10; A47H 1/102; A47H 1/104
USPC ..... 248/251, 261, 262, 264, 265, 333, 327, 248/323, 227.4, 214; 211/123, 204, 206, 211/105.1, 105.3, 119.009, 105.5, 105.6
See application file for complete search history.

(56) References Cited

U.S. PATENT DOCUMENTS 805,570 A * 11/1905 Maldaner ..... E06B 9/323 182/228.4
1,029,373 A * 6/1912 King ..... A47H 1/13 248/254
1,089,550 A * 3/1914 Hannon et al. ..... A47H 1/022 211/105.3
1,216,983 A * 2/1917 Goldberg ..... A47H 1/142 248/262
1,752,683 A * 4/1930 Meagher ..... A24B 1/08 211/123

(Continued)

OTHER PUBLICATIONS

Bathroom Shower Road Support and Wall Protector by PAW Int'l, retrieved from www.amazon.com/Bathroom-Shower-Support-Protector-PAW/, retrieved on Nov. 20, 2017, 7 pages.

*Primary Examiner* — Terrell L McKinnon
*Assistant Examiner* — Michael McDuffie
(74) *Attorney, Agent, or Firm* — Brian S. Steinberger; Law Offices of Brian S. Steinberger, P.A.

(57) ABSTRACT

Mounting brackets, assemblies, kits, devices, systems and methods for mounting brackets to walls adjacent to shower tile and shower enclosures, with the brackets having rod support ends over the tile or shower enclosure, where the mounting brackets are used as a replacement for a shower curtain tension rod so that non-tension curtain rods can be used, where the brackets securely hold the rod in place without accidental slippage, and the brackets are mounted without causing damage to the shower wall tiles and shower wall enclosure. The bracket includes a base having opposing ends. A semi-circular projection for supporting a shower rod is disposed on one end. A pair of apertures are disposed on the other end. The base is securable to a wall via fasteners insertable through the apertures. The shower rod bracket provides a mounting point for a shower rod and eliminates the need to use a spring-tensioned rod.

20 Claims, 9 Drawing Sheets

(56) References Cited

U.S. PATENT DOCUMENTS 2,199,851 A 5/1940 Culver
2,809,003 A * 10/1957 Graham ..... A47H 1/142 248/263
2,974,806 A 3/1961 Seewack
3,738,650 A * 6/1973 Ossenkop ..... A63B 1/005 248/264
3,749,344 A * 7/1973 Racina ..... A63K 3/046 248/218.4
3,857,538 A * 12/1974 Williamson ..... A47H 1/14 248/263
3,951,269 A 4/1976 Anderson
4,473,225 A * 9/1984 Miller ..... A63B 1/005 248/264
4,653,714 A * 3/1987 Andrasko, Jr. ..... A47K 3/001 211/105.1
4,700,918 A * 10/1987 Andrasko, Jr. ..... A47K 3/001 211/105.1
5,011,030 A * 4/1991 Alaurent ..... A47H 1/022 211/105.6
5,189,759 A * 3/1993 Poore ..... A47K 3/38 16/87.4 R
6,213,437 B1 * 4/2001 Robbins ..... A47H 1/142 160/330
6,381,771 B1 * 5/2002 Kelly ..... A47K 3/003 211/105.1
6,845,955 B1 * 1/2005 Hsu ..... A47H 1/102 211/123
8,214,938 B2 * 7/2012 Hanley ..... A47K 3/38 248/261
8,231,093 B2 * 7/2012 Tran ..... A47H 1/142 16/87.2
8,991,625 B2 * 3/2015 Bucklew ..... A47H 1/022 211/105.2
9,427,612 B1 * 8/2016 Swanson ..... A63B 1/005
2004/0178310 A1 * 9/2004 Marion ..... A47H 1/102 248/251
2006/0070966 A1 * 4/2006 Koudys ..... A47B 61/02 211/105.3
2017/0280942 A1 * 10/2017 Fraley ..... A47H 1/142

* cited by examiner

FIG. 7A
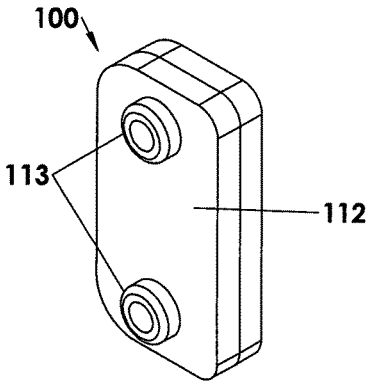
FIG. 7B
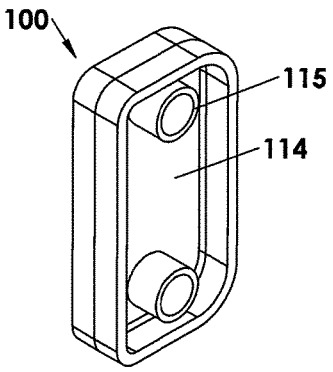
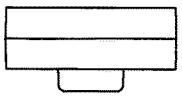
FIG. 7C
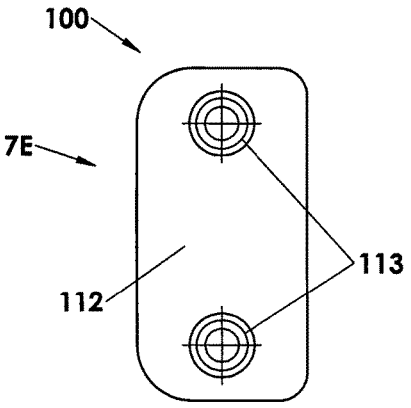
FIG. 7D
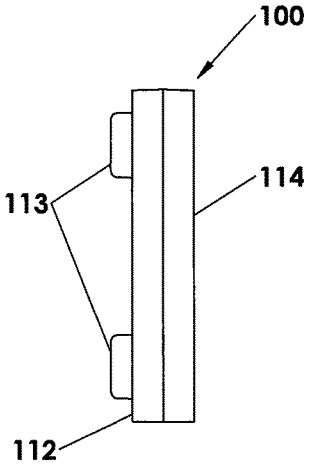
FIG. 7E
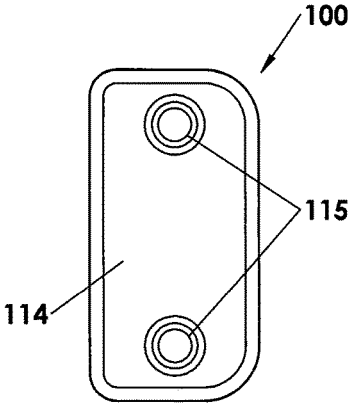
FIG. 7F

SHOWER ROD HOLDER

RELATED APPLICATION

This application claims the benefit or priority to U.S. Provisional Patent Application Serial No. 62/321,817 filed April 13, 2016, which is incorporated by reference in its' entirety.

FIELD OF INVENTION

This invention relates to shower curtain rods, and in particular to mounting brackets, assemblies, kits, devices, systems and methods for mounting brackets to walls adjacent to shower tile and shower enclosures, with the brackets having rod support ends over the tile or shower enclosure, where the mounting brackets are used as a replacement for a shower curtain tension rod so that non-tension curtain rods can be used, where the brackets securely hold the rod in place without accidental slippage, and the brackets are mounted without causing damage to the shower wall tiles and shower wall enclosure.

BACKGROUND AND PRIOR ART

Showers having curtains supported by rods are very popular to be used. The open portion of a shower is typically covered by a curtain, where the curtain is supported by a curtain rod disposed above the entrance to the shower. Mounting rod ends with fasteners, such as screws, and the like directly into tile walls or the walls of plastic type shower enclosures is generally not desirable Drilling holes into tile side walls or into shower enclosure walls, can result in breaking the surrounding tiles and enclosure walls, which can result in water leakage, water damage and the like. Typically curtain rods are held in place by tension rods or by mounting ends of the rods into side wall surfaces inside the shower.

Tensioned rods that are generally secured between two vertical surfaces, such as tiled side walls, or shower compartment walls, by tension formed by rotating telescoping poles with gasket type materials and/or with springs. See for example, U.S. Pat. Nos.: 2,199,851 to Culver; 2,974,806 to Seewack; and 3,951,269 to Anderson. Many people utilize tension rods because they do not require a bracket to mount and can be adjustable in length.

However, tension rods are not securely fastened to the walls and as such are prone to falling. It is common for an individual to grab hold of the shower curtain or hit against or lean against the rod, and accidentally dislodge the shower rod. This may cause the individual to slip and injure themselves, as well as cause potential water spillage out of the shower and into the bathroom.

Thus, the need exists for solutions to the above problems with the prior art.

SUMMARY OF THE INVENTION

A primary objective of the present invention is to provide mounting brackets, assemblies, kits, devices, systems and methods for mounting brackets to walls adjacent to shower tile and shower enclosures, with the brackets having rod support ends over the tile or shower enclosure, where the mounting brackets are used as a replacement for a shower curtain tension rod so that non-tension curtain rods or fixed length curtain rods can be used.

A secondary objective of the present invention is to provide mounting brackets, assemblies, kits, devices, systems and methods for mounting brackets to walls adjacent to shower tile and shower enclosures, with the brackets having rod support ends over the tile or shower enclosure, where the brackets securely hold the rod in place without accidental slippage.

A third objective of the present invention is to provide mounting brackets, assemblies, kits, devices, systems and methods for mounting brackets to walls adjacent to shower tile and shower enclosures, with the brackets having rod support ends over the tile or shower enclosure, where the brackets are secured without causing damage to the shower wall tiles and shower wall enclosure.

A fourth objective of the present invention is to provide mounting brackets, assemblies, kits, devices, systems and methods for mounting brackets to walls adjacent to shower tile and shower enclosures, with the brackets having rod support ends over the tile or shower enclosure, where different diameter curtain rods can be used.

A fifth objective of the present invention is to provide mounting brackets, assemblies, kits, devices, systems and methods for mounting brackets to walls adjacent to shower tile and shower enclosures, where the shower rod bracket can be secured to any wall and provides a secure mounting point for a shower curtain rod.

A bracket system for supporting curtain rods, can include a first elongated bracket having a left end and a right end, with a front side and a rear side, a first rod support adjacent to the right end on the front side of the first elongated bracket, and a second elongated bracket having a left end and a right end, with a front side and a rear side, a second rod support adjacent to the left end on the front side of the first elongated bracket, wherein the left end of the first elongated bracket and the right end of the second elongated bracket are adapted to be mounted to walls outside of a shower, with the right end of the first elongated bracket and the left end of the second elongated bracket adapted to be positioned on the walls of the shower, with the first rod support and the second rod support adapted to support ends of a shower curtain rod inside of the shower.

The rear side of the first elongated bracket adjacent to the left end of the first elongated bracket can include a first spacer adapted to be between a left wall the first elongated bracket is mounted to, and wherein the rear side of the second elongated bracket adjacent to the right end of the second elongated bracket includes a second spacer adapted to be between a right wall the second elongated bracket is mounted to.

The bracket system can include fasteners for mounting the left end of the first elongated bracket to a left wall outside of the shower, and for mounting the right end of the second elongated bracket to a right wall outside of the shower.

The fasteners can be selected from at least one of screws and bolts.

The first rod support and the second rod support, can each include curved projections extending outward from the front side of each of the elongated brackets adapted to fit under ends of the curtain rod.

The first elongated bracket and the second elongated bracket can each be formed from plastic.

The first elongated bracket and the second elongated bracket can each be formed from metal.

The first elongated bracket and the second elongated bracket can each have rectangular configurations.

A shower curtain hanging kit for supporting curtain rods, can include a first elongated bracket having a left end and a right end, with a front side and a rear side, a first rod support adjacent to the right end on the front side of the first elongated bracket, and a second elongated bracket having a left end and a right end, with a front side and a rear side, a second rod support adjacent to the left end on the front side of the first elongated bracket, wherein the left end of the first elongated bracket and the right end of the second elongated bracket are adapted to be mounted to walls outside of a shower, with the right end of the first elongated bracket and the left end of the second elongated bracket adapted to be positioned on the walls of the shower, and a shower curtain rod having a left end and a right end, the left end of the rod for being supported by the first rod support and the right end of the rod for being supported by the second rod support, so that the rod is inside the shower.

The rear side of the first elongated bracket adjacent to the left end of the first elongated bracket can include a first spacer adapted to be between a left wall the first elongated bracket is mounted to, and wherein the rear side of the second elongated bracket adjacent to the right end of the second elongated bracket includes a second spacer adapted to be between a right wall the second elongated bracket is mounted to.

The shower curtain hanging kit can include fasteners for mounting the left end of the first elongated bracket to a left wall outside of the shower, and for mounting the right end of the second elongated bracket to a right wall outside of the shower.

The fasteners can be selected from at least one of screws and bolts.

The first rod support and the second rod support can each include curved projections on the front side of each of the elongated brackets adapted to fit under the left and the right end of the curtain rod.

The first elongated bracket and the second elongated bracket can each be formed from plastic.

The first elongated bracket and the second elongated bracket can each be formed from metal.

The first elongated bracket and the second elongated bracket can each have rectangular configurations.

The curtain rod can have a fixed length rod. The curtain rod can have a tension length rod that is adjustable to different lengths.

Further objects and advantages of this invention will be apparent from the following detailed description of the presently preferred embodiments which are illustrated schematically in the accompanying drawings.

BRIEF DESCRIPTION OF THE FIGURES

FIG. 7A is a front perspective view of an alternative double spacer for use with the elongated brackets of the preceding FIGURES.

FIG. 7B is a rear perspective view of the alternative double spacer of FIG. 7A.

FIG. 7C is a top view of the alternative double spacer of FIG. 7A.

FIG. 7D is a front view of the alternative double spacer of FIG. 7A.

FIG. 7E is a side view of the double spacer of FIG. 7A along arrow 7E.

FIG. 7F is a rear view of the alternative double spacer of FIG. 7B.

DESCRIPTION OF THE PREFERRED EMBODIMENTS

Figure 1A:
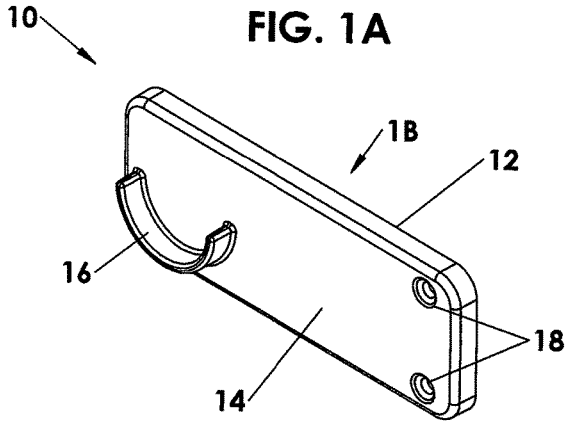
FIG. 1A shows a perspective view of a left shower rod bracket.

Before explaining the disclosed embodiments of the present invention in detail it is to be understood that the invention is not limited in its applications to the details of the particular arrangements shown since the invention is capable of other embodiments. Also, the terminology used herein is for the purpose of description and not of limitation.

In the Summary above and in the Detailed Description of Preferred Embodiments and in the accompanying drawings, reference is made to particular features (including method steps) of the invention. It is to be understood that the disclosure of the invention in this specification does not include all possible combinations of such particular features. For example, where a particular feature is disclosed in the context of a particular aspect or embodiment of the invention, that feature can also be used, to the extent possible, in combination with and/or in the context of other particular aspects and embodiments of the invention, and in the invention generally.

In this section, some embodiments of the invention will be described more fully with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will convey the scope of the invention to those skilled in the art. Like numbers refer to like elements throughout, and prime notation is used to indicate similar elements in alternative embodiments.

A list of components will now be described.

10 left elongated bracket/flange/base
12 rear side
14 front side
16 left end rod support
18 apertures for fasteners 40
20 right elongated bracket/flange/base
22 rear side
24 front side
26 right end rod support
28 apertures for fasteners 40
30 spacer/riser
32 front side
33 male protruding apertures
34 rear side
35 female socket apertures
40 fasteners
50 inside shower wall (tile or shower enclosure wall
60 outer wall outside of the shower
70 curtain rod
80 curtain
100 double spacer/riser
112 front side
113 male protruding apertures
114 rear side
115 female socket apertures.

Figure 1B:
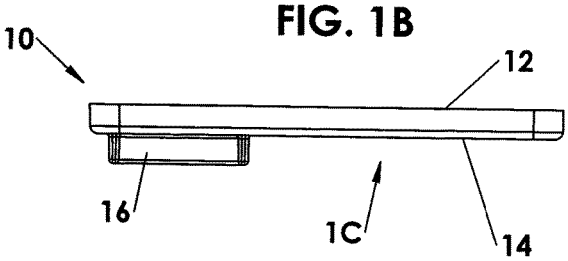
FIG. 1B is a top view of the left shower rod bracket of FIG. 1A along arrow 1B.
Figure 1C:
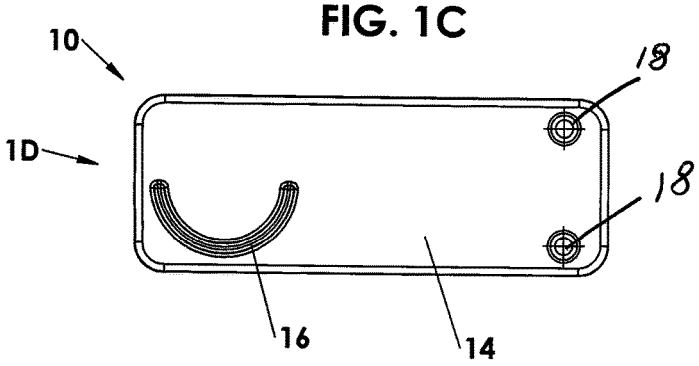
FIG. 1C is a front view of the left shower rod bracket of FIG. 1B along arrow 1C.
Figure 1D:
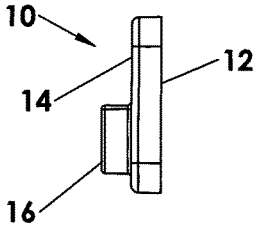
FIG. 1D is a left end view of the left shower rod bracket of FIG. 1C along arrow 1D.

FIG. 1A shows a perspective view of a left shower rod bracket 10. FIG. 1B is a top view of the left shower rod bracket 10 of FIG. 1A. FIG. 1C is a front view of the left shower rod bracket 10 of FIG. 1A. FIG. 1D is a left end view of the left shower rod bracket 10 of FIG. 1A.

Referring to FIGS. 1A-1D, the left shower rod bracket 10 can include a rear side 12, a front side 14, with a left end rod support 16. The rod support 16 can be an outwardly protruding curved projection, such as a semi-circular projection, and the like, on the front side 14 adjacent to the left side of the bracket 10. A pair of through-hole apertures 18 used for fasteners, to be described later, can be through the front side 14 and rear side 16 of the bracket 10 adjacent to the right side of the bracket 10.

Figure 2A:
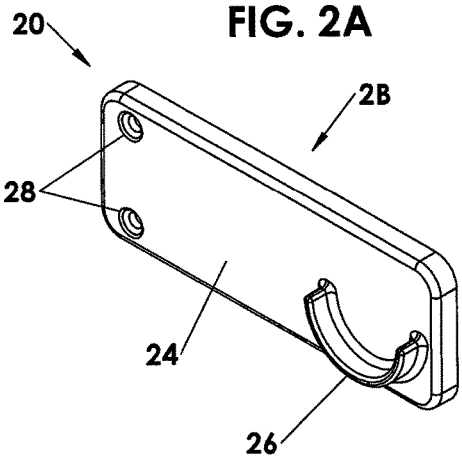
FIG. 2A shows a perspective view of a right shower rod bracket.
Figure 2B:
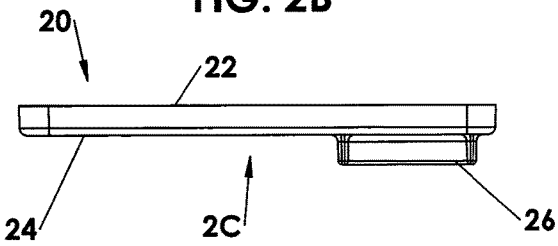
FIG. 2B is a top view of the right shower rod bracket of FIG. 2A.
Figure 2C:
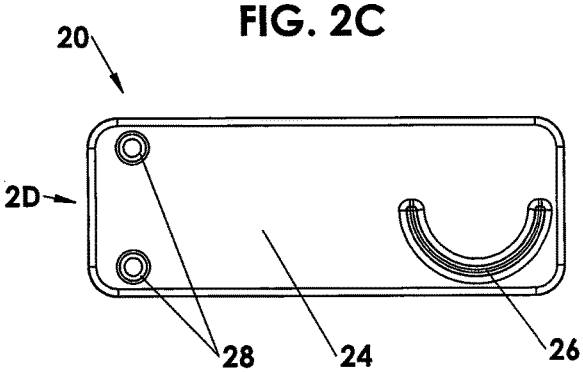
FIG. 2C is a front view of the right shower rod bracket of FIG. 2A.
Figure 2D:
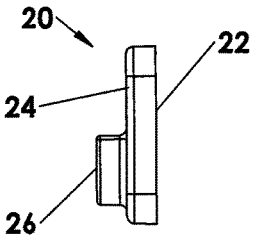
FIG. 2D is a left end view of the right shower rod bracket of FIG. 2A.

FIG. 2A shows a perspective view of a right shower rod bracket 20. FIG. 2B is a top view of the right shower rod bracket 20 of FIG. 2A. FIG. 2C is a front view of the right shower rod bracket 20 of FIG. 2A. FIG. 2D is a left end view of the right shower rod bracket 20 of FIG. 2A.

Referring to FIGS. 1A-2D, the right shower rod bracket 20 can include a rear side 22, a front side 24, with a right end rod support 26. The rod support 26 can be an outwardly protruding curved projection, such as a semi-circular projection, and the like, on the front side 24 adjacent to the right side of the bracket 20. A pair of through-hole apertures 28 used for fasteners, to be described later, can be through the front side 24 and rear side 26 of the bracket 10 adjacent to the left side of the bracket 20.

Figure 3B:
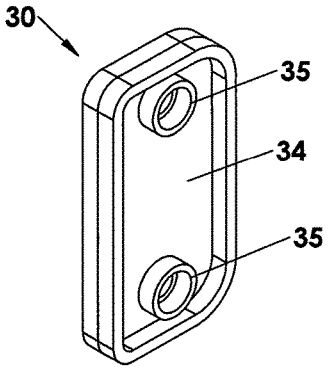
FIG. 3B is a rear perspective view of the spacer of FIG. 3A.
Figure 3A:
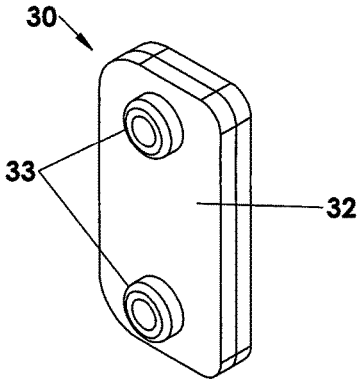
FIG. 3A is a front perspective view of a spacer for use with the brackets of the preceding figures.
Figure 3C:
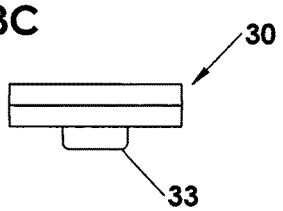
FIG. 3C is a top view of the spacer of FIG. 3A.
Figure 3D:
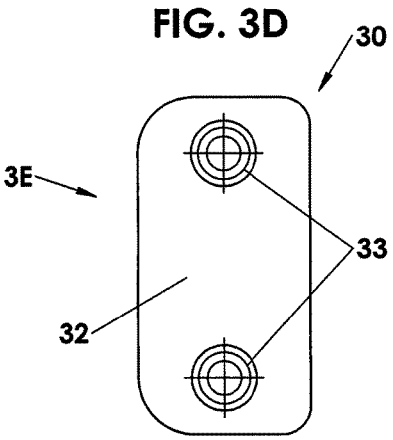
FIG. 3D is a front view of the spacer of FIG. 3A.
Figure 3E:
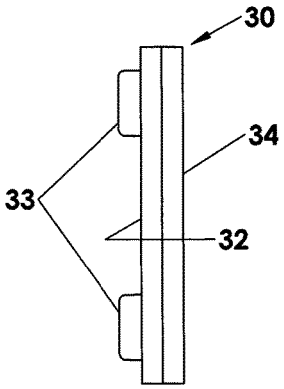
FIG. 3E is a side view of the spacer of FIG. 3A along arrow 3E.
Figure 3F:
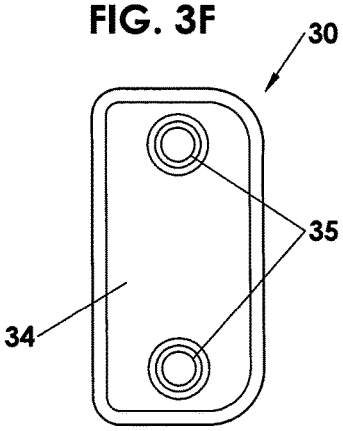
FIG. 3F is a rear view of the spacer of FIG. 3B.

FIG. 3A is a front perspective view of a spacer 30 for use with the brackets 10, 20 of the preceding figures. FIG. 3B is a rear perspective view of the spacer 30 of FIG. 3A. FIG. 3C is a top view of the spacer 30 of FIG. 3A. FIG. 3D is a front view of the spacer 30 of FIG. 3A. FIG. 3E is a side view of the spacer 30 of FIG. 3A along arrow 3E. FIG. 3F is a rear view of the spacer 30 of FIG. 3B.

Referring to FIGS. 3A-3F, the spacer can include a front side 32 having a pair of outwardly protruding male members 33 with apertures therethrough, and a rear side 34 with a pair of female socket apertures 35. The male members 33 mateably (can friction fit or snap fit) into sockets in the rear side 12, 22 of the first and second elongated brackets 10, 20 previously described.

Figure 4A:
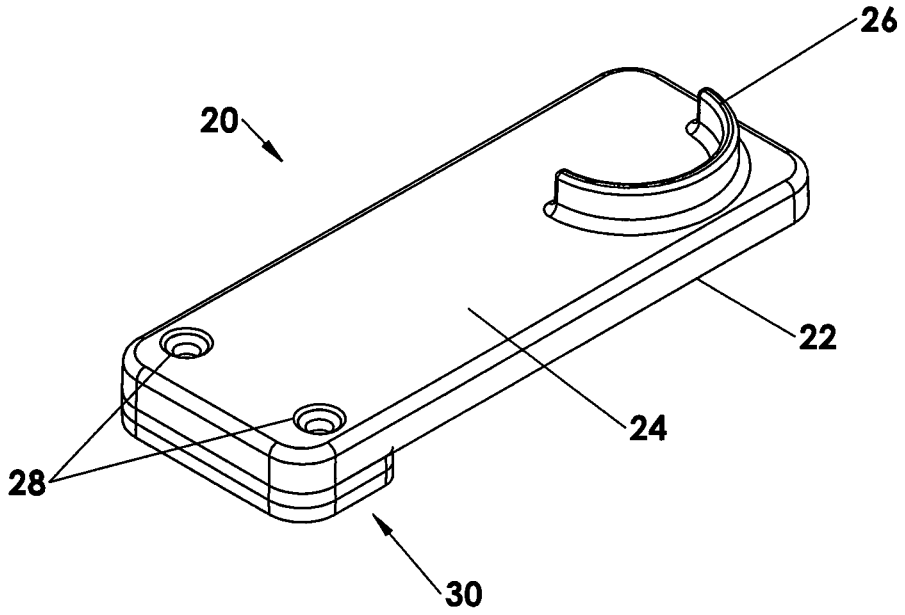
FIG. 4A is a perspective view of the right bracket of FIGS. 2A-2D with the spacer of FIGS. 3A-3F.

FIG. 4 is a perspective view of the right bracket 20 of FIGS. 2A-2D with the spacer 30 of FIGS. 3A-3F attached to the rear side 22 of the second elongated bracket 20 adjacent to the left side. Similarly, the spacer 30 can be similarly attached to the rear side 12 of the first elongated bracket 10 adjacent to the right side.

Figure 5A:
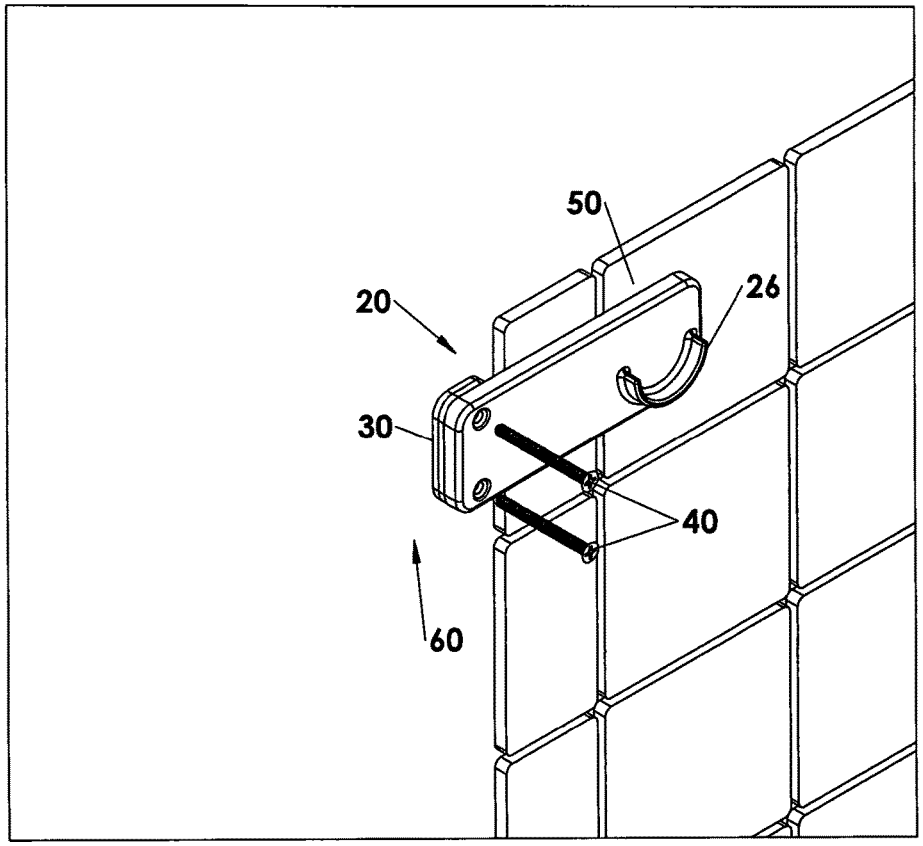
FIG. 5A is a perspective view of the left bracket of FIGS. 1A-1D about to be mounted to a wall outside a shower.

FIG. 5A is a perspective view of the left bracket 20 of FIGS. 1A-1D with attached spacer 30 about to be mounted to a wall 60 outside an interior wall 50 of a shower. The wall 60 can be existing drywall outside of the interior shower wall 50. The shower wall 60 can be a tile wall, or shower enclosure wall. The spacer 30 can have a thickness at least as thick as the thickness of the tile surface 50 or shower enclosure surface 50 that would be raised above the outer wall 60.

Figure 5B:
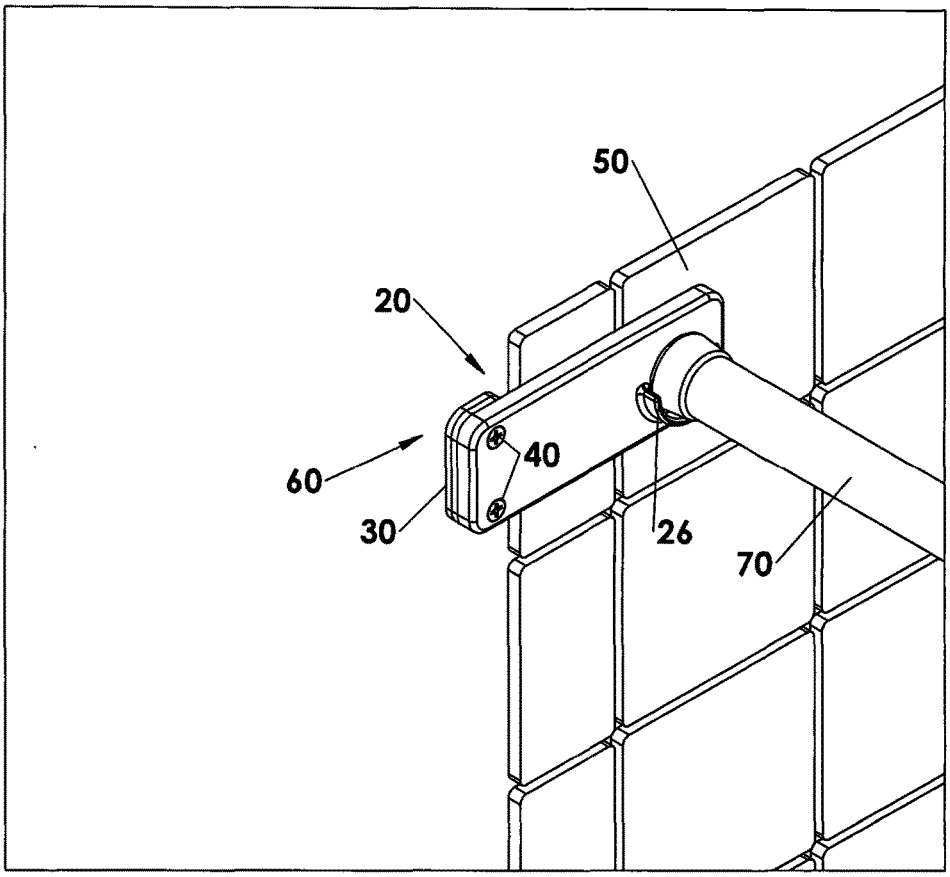
FIG. 5B is a perspective view of FIG. 5A with the left bracket mounted to the left wall outside the shower with a curtain rod supported thereon.

FIG. 5B is a perspective view of FIG. 5A with the left bracket 20 mounted to the left wall 60 outside the shower wall 50 with a curtain rod 70 supported on the left rod support 26. Here, fasteners 40, such as screws or bolts, can be screwed into the outer wall surface. Additional anchors, can be inserted into the drywall 60 or existing wall before the fasteners 40 are used.

The rear side 22 of the bracket 20 can rest against the shower wall 60, or be cantilevered (slightly spaced away from the shower wall 60. Additionally, a resilient member, such as elastomeric or rubber type washer can be used on the rear side 22 of the bracket 20. The right bracket 10 can be similarly mounted on the opposite wall of the shower outside of the inner wall 50 of the shower.

Figure 5C:
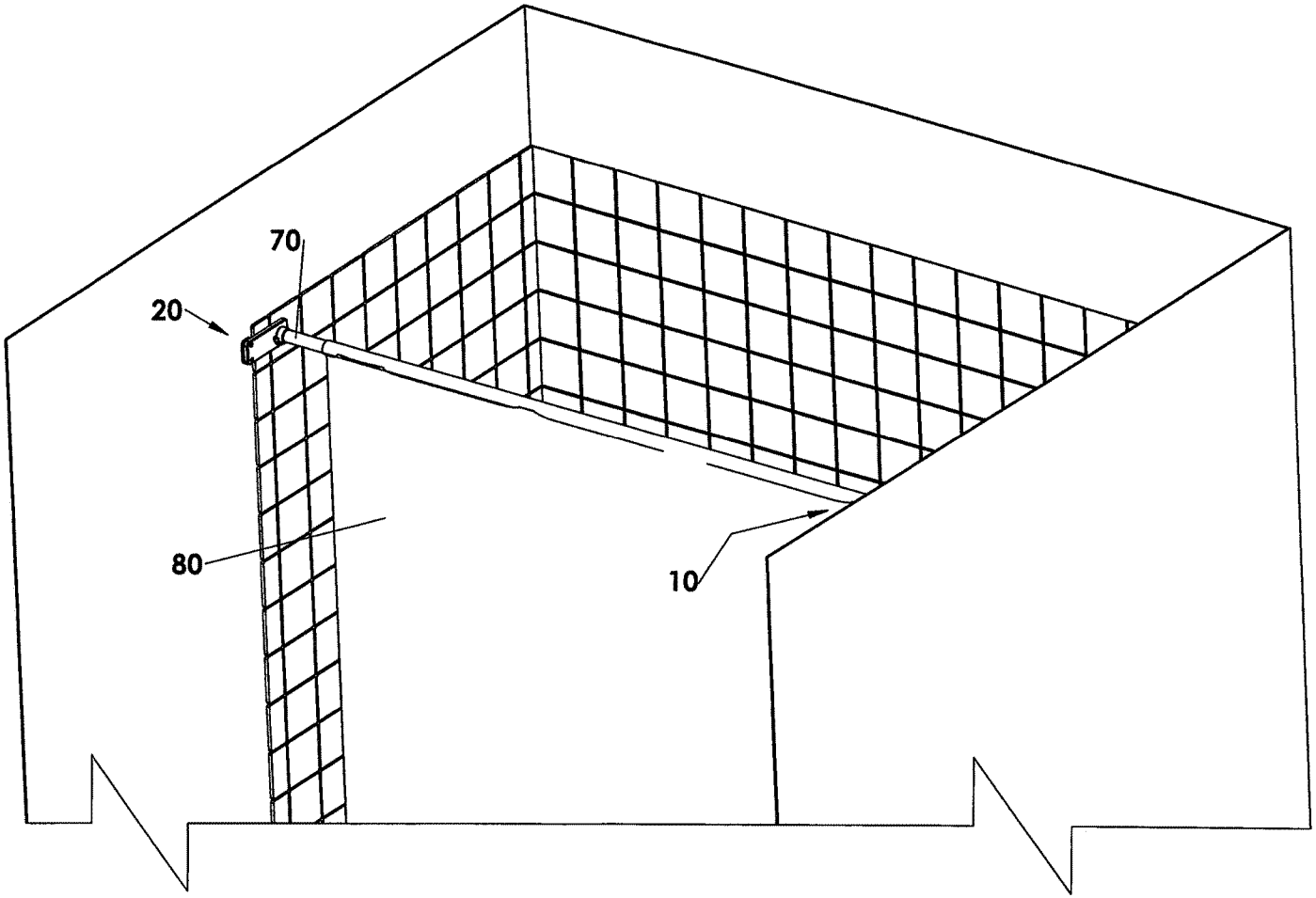
FIG. 5C is an enlarged perspective view of FIG. 5B with both the left bracket mounted to the left wall outside the shower and right bracket mounted to a right wall outside the shower (not shown) with a curtain on the rod.

FIG. 5C is an enlarged perspective view of FIG. 5B with both the left bracket 20 mounted to the left wall outside the shower and right bracket 10 mounted to a right wall outside the shower (not shown) with a curtain 80 on the rod 70. With this mounting arrangement, the curtain rod 70 with curtain 80 cannot be easily knocked off or accidentally removed from the mounting brackets 10 and 20.

Figure 6:
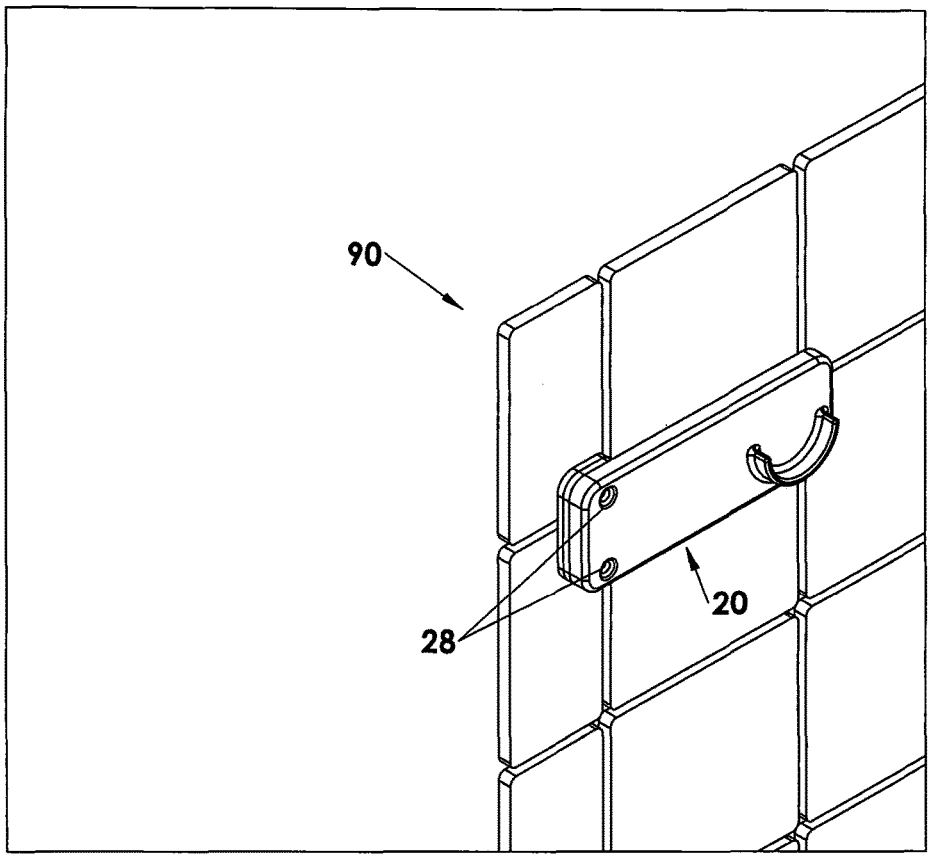
FIG. 6 is an alternative mounting arrangement for the elongated bracket inside the shower.

FIG. 6 is an alternative mounting arrangement 90 for the elongated bracket 20 inside the shower. Here, the mounting ends of the bracket 20, can be fastened by fasteners 40 such as those previously described, or by other fasteners, such as but not limited to peel and stick tape, hook and loop fasteners, and the like.

FIG. 7A is a front perspective view of an alternative double spacer 100 for use with the elongated brackets 10, 20 of the preceding FIGURES. FIG. 7B is a rear perspective view of the alternative double spacer 100 of FIG. 7A. FIG. 7C is a top view of the alternative double spacer 100 of FIG. 7A. FIG. 7D is a front view of the alternative double spacer 100 of FIG. 7A. FIG. 7E is a side view of the double spacer 100 of FIG. 7A along arrow 7E. FIG. 7F is a rear view of the alternative double spacer 100 of FIG. 7B.

Referring to FIGS. 7A-7F, the alternative double spacer 100 can be a combination of two of the spacers 30 previously described that can be sandwiched and interlocked together, with similar front side 112, outwardly protruding male members 113, and rear side 114 with female sockets 115. Fasteners 40, such as screws and bolts can pass through the apertures and into aligned apertures 18, 28 of the brackets 10, 20 and into a wall 60, as previously described.

The brackets can be formed from molded plastic. Additionally, the brackets, can be made from metal such as stainless steel or galvanized metal, aluminum and the like.

The brackets can have different colors, such as white to blend into the outer walls, as well as other colors, and the like.

While the spacer(s) are shown as separate parts, the spacer(s) can be formed with the brackets, such as being molded with the elongated brackets.

Although the rod supports on each of the brackets are shown as outwardly protruding curved projections, the rod supports can be indented into the brackets having curved surfaces. Alternatively, the rod supports can be tubular projections adapted for the rod ends to be inserted into, or circular indentations in the front sides of the brackets for supporting ends of the rods.

While a pair of apertures are shown on ends of the brackets for the mounting fasteners, the brackets can be used with one aperture, or more than two apertures on their ends. Additionally, the bracket can be mounted with clips on their ends to attach to the mounts.

Although the fasteners are described as screws and bolts, other types of fasteners, such can be used, such as but not limited to peel and stick tape, hook and loop fasteners, interlocking mushroom head fasteners, and the like.

While the drawings generally shown, elongated brackets having a generally rectangular shape, the brackets can have other geometric shapes and the like.

Although the drawings show the brackets being oriented horizontal to have one end attached to a wall to the left and to the right of the shower, the brackets can be mounted vertically with upper ends mounted to walls above the shower walls.

The brackets can be sold in kits, and the like with or without curtain rods. The rods can be non-tension rods such as existing metal or plastic rods, cylinders, and the like, that can be cut to different lengths.

The brackets can also be used with tension rods. The brackets allow for different diameter curtain rods to be used from small diameter of less than approximately 1 inch to larger diameter rods of greater than approximately 2 to approximately 3 inches.

The term "approximately" can be +/− 10% of the amount referenced. Additionally, preferred amounts and ranges can include the amounts and ranges referenced without the prefix of being approximately.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim:

1. A bracket system for supporting curtain rods, comprising:

a first elongated bracket having a left end and a right end, a top end and a bottom end, with a front side and a rear side, each of the top end and the bottom end having a longer length than each of the left end and the right end;

a first curved rod support adjacent to the right end on the front side of the first elongated bracket, the first curved rod support having a concave shaped indentation that faces toward the top end of the first elongated bracket;

a second elongated bracket having a left end and a right end, a top end and a bottom end, with a front side and a rear side, each of the top end and the bottom end having a longer length than each of the left end and the right end; and a second curved rod support adjacent to the left end on the front side of the first elongated bracket, the second curved rod support having a concave shaped indentation that faces toward the top end of the second elongated bracket, wherein the left end of the first elongated bracket and the right end of the second elongated bracket are adapted to he mounted to walls outside of a shower, with the right end of the first elongated bracket and the left end of the second elongated bracket adapted to be positioned on the walls of the shower, with the first rod support and the second rod support adapted to support ends of a shower curtain rod inside of the shower.

2. The bracket system of claim 1, wherein the rear side of the first elongated bracket adjacent to the left end of the first elongated bracket includes a first spacer adapted to be between a left wall the first elongated bracket is mounted to, and wherein the rear side of the second elongated bracket adjacent to the right end of the second elongated bracket includes a second spacer adapted to be between a right wall the second elongated bracket is mounted to.

3. The bracket system of claim 1, further comprising:

fasteners for mounting the left end of the first elongated bracket to a left wall outside of the shower, and for mounting the right end of the second elongated bracket to a right wall outside of the shower.

4. The bracket system of claim 3, wherein the fasteners are selected from at least one of screws and bolts.

5. The bracket system of claim 1, wherein the first rod support and the second rod support, each include:

curved projections extending outward from the front side of each of the elongated brackets adapted to fit under ends of the curtain rod.

6. The bracket system of claim 1, wherein the first elongated bracket and the second elongated bracket are each formed from plastic.

7. The bracket system of claim 1, wherein the first elongated bracket and the second elongated bracket are each formed from metal.

8. The bracket system of claim 1, wherein the first elongated bracket and the second elongated bracket each have rectangular configurations.

9. A shower curtain hanging kit for supporting curtain rods, comprising:

a first elongated bracket having a left end and a right end, a top end and a bottom end, with a front side and a rear side, each of the top end and the bottom end having a length longer than each of the left end and the right end;

a first curved rod support adjacent to the right end on the front side of the first elongated bracket, the first curved rod support having a concave shaped indentation that faces upward toward the top, end of the first elongated bracket; and a second elongated bracket having a left end and a right end, a top end and a bottom end, with a front side and a rear side, each of the top end and the bottom end having a length longer than each of the left end and the right end;

a second curved rod support adjacent to the left end on the front side of the first elongated bracket, tie second curved rod support having a concave shaped indentation that faces upward toward the top end of the second elongated bracket, wherein the left end of the first elongated bracket and the right end of the second elongated bracket are adapted to be mounted to walls outside of a shower, with the right end of the first elongated bracket and the left end of the second elongated bracket adapted to be positioned on the walls of the shower; and a shower curtain rod having a left end and a right end, the left end of the rod for being supported by the first rod support and the right end of the rod for being supported by the second rod support, so that the rod is inside the shower.

10. The shower curtain hanging kit of claim 9, wherein the rear side of the first elongated bracket adjacent to the left end of the first elongated bracket includes a first spacer adapted to be between a left wall the first elongated bracket is mounted to, and wherein the rear side of the second elongated bracket adjacent to the right end of the second elongated bracket includes a second spacer adapted to be between a right wall the second elongated bracket is mounted to.

11. The shower curtain hanging kit of claim 9, further comprising:

fasteners for mounting the left end of the first elongated bracket to a left wall outside of the shower, and for mounting the right end of the second elongated bracket to a right wall outside of the shower.

12. The shower curtain hanging kit of claim 11, wherein the fasteners are selected from at least one of screws and bolts.

13. The shower curtain hanging kit of claim 9, wherein the first rod support and the second rod support, each include:

curved projections on the front side of each of the elongated brackets adapted to fit under the left and the right end of the curtain rod.

14. The shower curtain hanging kit of claim 9, wherein the first elongated bracket and the second elongated bracket are each formed from plastic.

15. The shower curtain hanging kit of claim 9, wherein the first elongated bracket and the second elongated bracket are each formed from metal.

16. The shower curtain hanging kit of claim 9, wherein the first elongated bracket and the second elongated bracket each have rectangular configurations.

17. The shower curtain hanging kit of claim 9, wherein the curtain rod includes:

a fixed length rod.

18. The shower curtain hanging kit of claim 9, wherein the curtain rod includes:

a tension length rod that is adjustable to different lengths.

19. The bracket system of claim wherein the first curved rod support is closer to the right end on the front side of the first elongated bracket than to the left end on the front side of the first elongated bracket, and wherein the second curved rod support is closer to the left end on the front side of the second elongated bracket than to the right end of the front side of the second elongated bracket.

20. The shower curtain hanging kit of claim 9, wherein the first curved rod support is closer to the right end on the front side of the first elongated bracket than to the left end on the front side of the first elongated bracket, and wherein the second curved rod support is closer to the left end on the front side of the second elongated bracket than to the right end of the front side of the second elongated bracket.

* * * * *